US010131527B2

(12) United States Patent
Fickert

(10) Patent No.: US 10,131,527 B2
(45) Date of Patent: Nov. 20, 2018

(54) METHOD AND FILLING SYSTEM FOR FILLING CONTAINERS

(71) Applicant: KHS GmbH, Dortmund (DE)

(72) Inventor: Hilmar Fickert, Kriftel (DE)

(73) Assignee: KHS GmbH, Dortmund (DE)

( * ) Notice: Subject to any disclaimer, the term of this patent is extended or adjusted under 35 U.S.C. 154(b) by 79 days.

(21) Appl. No.: 14/901,238

(22) PCT Filed: Jun. 13, 2014

(86) PCT No.: PCT/EP2014/062427
§ 371 (c)(1),
(2) Date: Dec. 28, 2015

(87) PCT Pub. No.: WO2014/206774
PCT Pub. Date: Dec. 31, 2014

(65) Prior Publication Data

US 2016/0368751 A1 Dec. 22, 2016

(30) Foreign Application Priority Data

Jun. 27, 2013 (DE) ..... 10 2013 106 756

(51) Int. Cl.
*B67C 3/28* (2006.01)
*B67C 3/22* (2006.01)
*B67C 3/06* (2006.01)
*B67C 3/26* (2006.01)

(52) U.S. Cl.
CPC ..... *B67C 3/287* (2013.01); *B67C 3/06* (2013.01); *B67C 3/225* (2013.01); *B67C 3/26* (2013.01); *B67C 3/286* (2013.01)

(58) Field of Classification Search
CPC ..... B65B 3/12; B65B 39/004; B67C 3/26; B67C 3/286; B67C 3/287; B67C 3/06; B67C 3/225; B67C 3/283; B67C 2/2614
USPC ..... 141/234, 244
See application file for complete search history.

(56) References Cited

U.S. PATENT DOCUMENTS 3,999,689 A * 12/1976 Ciantro ..... B01L 3/0203 222/108
4,557,301 A * 12/1985 Jorss ..... B65B 3/26 141/102
5,287,896 A * 2/1994 Graffin ..... B65B 3/28 141/1

(Continued)

FOREIGN PATENT DOCUMENTS

DE 690 00 764 5/1993
DE 197 01 001 7/1998

(Continued)

*Primary Examiner* — Jason K Niesz
*Assistant Examiner* — James Hakomaki
(74) *Attorney, Agent, or Firm* — Occhiuti & Rohlicek LLP

(57) ABSTRACT

A method for filling containers simultaneously with the filling-material sealing the containers against filling heads at the filling positions, and using a filling-material volumetric-flow-rate controller common to all of the filling positions to control flow of filling-material as a function of a target filling-curve by executing a filling phase with intervals that have different flow rates and controlling transition times between these intervals to ensure that each container finishes the filling phase with the correct amount of filling-material.

19 Claims, 5 Drawing Sheets

(56) References Cited

U.S. PATENT DOCUMENTS

| | | | | | |
|---|---|---|---|---|---|
| 5,515,888 | A * | 5/1996 | Graffin | B65B 3/28 | 141/1 |
| 6,213,169 | B1 * | 4/2001 | Clusserath | B67C 3/10 | 141/40 |
| 6,276,409 | B1 * | 8/2001 | Ellison | B65B 21/04 | 141/178 |
| 6,474,368 | B2 * | 11/2002 | Clusserath | B67C 3/286 | 141/129 |
| 2005/0189038 | A1 * | 9/2005 | Navarro | B65B 39/004 | 141/234 |
| 2010/0192521 | A1 * | 8/2010 | Clusserath | B67C 3/28 | 53/473 |
| 2011/0005635 | A1 * | 1/2011 | Knieling | B67C 3/02 | 141/1 |
| 2011/0017345 | A1 * | 1/2011 | Monzel | B67C 3/30 | 141/1 |
| 2011/0303322 | A1 * | 12/2011 | Clusserath | B67C 3/286 | 141/8 |
| 2012/0152402 | A1 * | 6/2012 | Meinzinger | B67C 3/287 | 141/1 |

FOREIGN PATENT DOCUMENTS

| | | | |
|---|---|---|---|
| EP | 0 406 092 | | 1/1991 |
| EP | 0 979 207 | | 7/2001 |
| JP | 2003231590 | A * | 8/2003 |
| WO | WO2008/009400 | | 1/2008 |

* cited by examiner

METHOD AND FILLING SYSTEM FOR FILLING CONTAINERS

RELATED APPLICATIONS

This application is the national stage under 35 USC 371 of international application PCT/EP2014/062427, filed on Jun. 13, 2014, which claims the benefit of the Jun. 27, 2013 priority date of German application DE 102013106756.5, the contents of which are herein incorporated by reference.

FIELD OF INVENTION

The invention relates to filling containers, and in particular, to filling containers according to a target filling-curve.

BACKGROUND

In the container processing industry, it is known to fill relatively large-volume keg-like containers or kegs, during a filling phase of a filling process. It is also known that the amount of filling-material flowing into the keg should be controlled. Known methods involve using a volumetric flow-rate controller or filling-material volume controller, and controlling as a function of a filling curve stored in a control computer.

A disadvantage of known methods is that kegs are filled one at a time.

SUMMARY

An object of the invention is to present a method for simultaneously filling two or more containers with the required filling precision using only a single filling-material flow controller, and specifically by taking account of a target filling-curve.

A particular feature of the method according to the invention is that, with only a single filling-material volumetric flow-rate controller, the simultaneous or temporally parallel filling of at least two containers, and preferably of more than two containers, takes place via filling heads, of which in each case one is allocated to each container. Since in practice, with regard to the filling-material volume flow that flows into the individual containers or to the filling heads during the filling phase, it is not possible to achieve absolutely the same conditions, the invention makes provision that the control of a total filling-material volume flow, and therefore of the filling-material volume flows to the filling heads, does indeed generally take place by way of the individual filling-material flow controller, but each filling-material volume flow flowing to a container is monitored by an independent flow-meter, and, with the measurement result from this flow-meter, this flow is corrected.

The general controlling of the filling-material volumetric flow-rate controller is carried out in accordance with a target filling-curve, which is either a standardized filling curve or a filling curve specific to a filling-material and/or specific to a container.

By way of the method according to the invention, a substantial simplification of the filling system in terms of design and technical control aspects can be achieved by reducing the number of function elements required. In particular, only a single filling-material volumetric flow-rate controller is required, and, for example, also only a single filling-material pump for the provision of the filling-material, and specifically despite the possibility of simultaneously filling at least two containers, but preferably more than two containers, with the degree of filling precision required.

With the method according to the invention, the containers have preferably a container or filling volume in the range of between three and ten liters. If the target filling-curve exhibits part phases with differing volume flows, the correction control takes place, for example, by moving the point in time of the transition between individual part phases. In any event, however, on the basis of the measured values from the flow-meters, a final termination of the filling or filling phase for each container is reached when the required total filling volume has passed into it.

In a further embodiment of the invention, the method is arranged, for example, such that, by means of the control computer, on the basis of the measured values provided to it from the flow-meters, a temporal displacement of the transition between at least two part phases of the target filling-curve is effected, for example between the filling phase with the reduced filling-material volume flow (Q1) and the quick filling phase with the increased filling-material volume flow (Q2) and/or between the quick filling phase and the end filling phase, and/or that, by means of the control computer, on the basis of the measured values provided to it from the flow meters, a temporal displacement of the ending of the filling phase takes place, and/or that the control computer monitors the individual actual filling curves in parallel, and, taking the results of the comparison with the target filling-curve as a starting point, controls the filling process or the filling-material volumetric flow-rate controller respectively, and/or that the correction of the actuation of the filling-material volumetric flow-rate controller takes place by a comparison of the filling-material volume flow acquired by the flow-meters and the corresponding actual filling curves at the containers with the target filling-curve deposited in the control computer, and that, in the event of a deviation, the correction of the actuation of the filling-material volumetric flow-rate controller takes place, for example by the time of the transition between at least two sub-phases of the desired filling curve, and/or that, on the basis of the measured values provided by the flow-meters, the control computer only carries out a temporal switchover from the filling phase to the quick filling phase when the minimum filling-material quantity has also been introduced into those containers of which the filling is slowest, which was delivered at the beginning of the quick filling phase, and/or that the switchover from the quick filling phase to the subsequent phase then takes place with a reduced or reducing filling-material volume flow (Q3), for example to an end filling phase, when that container into which the filling-material flows at the greatest flow-rate is filled with the filling-material quantity required at the end of the quick filling phase, and/or that, with a counter-pressure filling of the containers pre-tensioned with a tensioning gas, the return gas forced by the liquid filling-material out of the containers is conducted via a return-gas line, common to all the filling points, in which a return gas regulator is provided in order to maintain a constant return gas pressure, and/or that with the pressure filling of a filling-material containing $CO_2$, the tension gas pressure and/or the return gas pressure lies slightly above the $CO_2$ equalizing pressure of the filling-material, amounting, for example, to 1.5 bar, and/or that for the actuation of the filling-material volumetric flow-rate controller a target filling-curve specific to a product and/or a container is used, wherein the features referred to heretofore can be used in each case individually or in any desired combination.

In one aspect, the invention features a method for filling containers simultaneously with the filling-material, wherein filling containers simultaneously by placing the containers at corresponding filling positions, sealing the containers against filling heads at the filling positions, and, using a filling-material volumetric-flow-rate controller that is common to all of the filling positions, controlling flow of filling-material as a function of a target filling-curve. Controlling flow using the filling-material volumetric flow-rate controller includes at a first transition time, beginning a filling phase by causing filling-material to flow at a first flow-rate, thereby beginning a first interval of the filling phase, at a second transition time, increasing the first flow-rate to a second flow-rate, thereby ending the first interval and beginning a second interval of the filling phase, at a third transition time, reducing the second flow-rate to a third flow-rate, thereby ending the second interval and beginning a third and final interval of the filling phase, and at a fourth transition time, ending the filling phase. During the filling phase, actual filling-curves associated with each of the containers are measured, and, based at least in part on these measured actual filling-curves, a control computer implements a correction to cause equal volumes of filling-material to be in each container upon completion of the filling phase.

In some practices, causing a control computer to implement a correction includes causing a temporal displacement of either the second transition time, the third transition time, or possibly both.

In other practices, causing a control computer to implement a correction includes causing a temporal displacement of the fourth transition time.

Some practices include causing the control computer to measure the actual filling-curves in parallel. Among these practices are those that also include comparing the actual filling-curves with the target filling-curve, detecting a deviation between at least one actual filling-curve and the target filling-curve, and, in response, causing a change in at least one of the transition times.

Among the containers, there exists a last container that fills more slowly than all others of the containers. In some practices, the method further includes causing a transition between the first interval and the second interval only when a minimum filling quantity required at the beginning of the second interval has been introduced into the last container.

During the second interval, there exists a first container that fills faster than all other containers. Some practices include switching from the second interval to the third interval only when a filling-material quantity required at the end of the second interval has been filled into the first container.

Yet other practices include pre-tensioning the containers with tensioning gas, conducting away return gas via a return gas line common to all of the filling positions, and maintaining a constant return gas pressure using a return gas regulator.

In some practices, the filling-material is carbonated. In these practices, either a tension gas pressure or a return gas pressure is maintained to above the filling-material's CO2 balance pressure, for example, 1.5 bar above the balance pressure.

Practices of the invention also include those in which the target filling-curve is selected to be specific to the container, those in which it is selected to be specific to the filling-material, and those in which it is selected to be specific to the combination of container and filling-product.

In another aspect, the invention features an apparatus for simultaneously filling containers with liquid filling-material. Such an apparatus includes a control computer, a filling-material volumetric flow-rate controller, filling positions, and branched product lines connecting the filling positions to the controller. Each of the filling positions has a filling head, a tension valve, a liquid valve, a return-gas valve, and an independent flow meter in a product line leading to the filling head. The control computer actuates the controller according to a target filling-curve. The controller then controls filling-material volume flow to the filling positions as a function of a target filling-curve that is stored on the control computer. The target filling-curve defines a filling phase that consists of three intervals, each with its own flow rate. These intervals follow each other in sequence with the second being between the first and third. Among the flow rates, that of the second interval is the greatest.

In some embodiments, each filling head further comprises a filling pipe that is configured to be extended into a container to be filled.

Other embodiments include a common tension gas line, a common return gas line, and a return gas regulator, and a pressure sensor, both of which are along the common return gas line. The tension valves of the filling heads all connect to the common tension gas line, and the return gas valves of the filling heads all connect to the common return gas line. The return gas regulator maintains constant return gas pressure in the return gas line based at least in part on a pressure signal provided by the pressure sensor.

In some embodiments, the controller, the branched product lines, and the filling positions define a preassembled component unit that is configured to be mounted on a filling machine.

Further embodiments, advantages, and application possibilities of the invention are also derived from the following description of embodiments and from the figures. In this context, all the features described and/or pictorially represented are, by themselves or in any desired combination in principle the object of the invention, regardless of their inclusion in the claims or reference to them. The contents of the claims are also constituent parts of the description.

BRIEF DESCRIPTION OF THE DRAWINGS

These and other features and advantages of the invention will be apparent from the following detailed description and the accompanying figures, in which.

DETAILED DESCRIPTION

Figure 1:
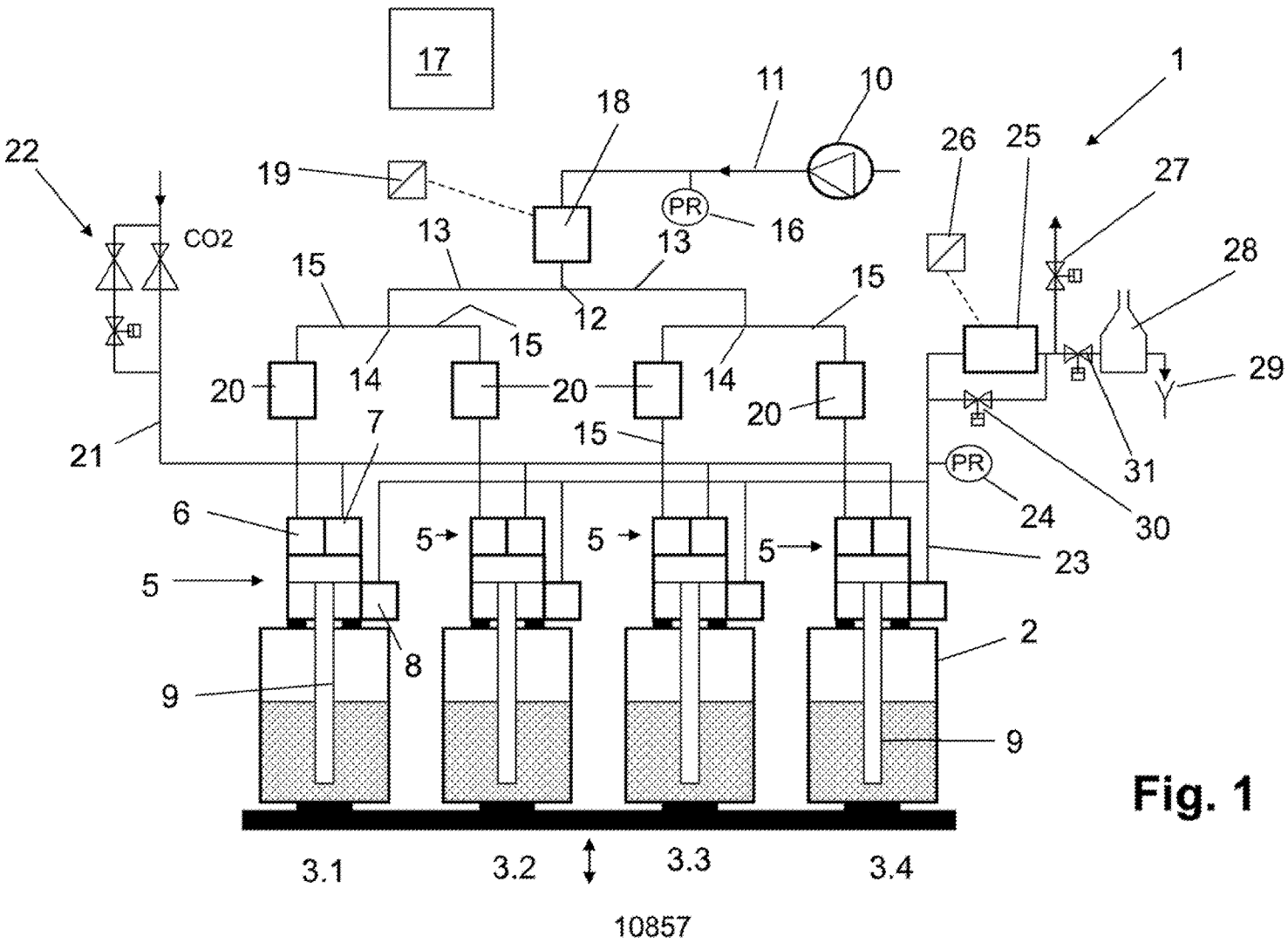
FIG. 1 shows a filling system for the simultaneous or parallel filling of plural containers.

FIG. 1 shows a filling system 1 that is a constituent part of a filling machine. The filling system 1 simultaneously pressure fills four containers 2 with filling-material. An example of a filling-material is one that contains $CO_2$, such as beer. The containers 2 are preferably cans, such as party cans, or kegs with large volumes. Examples of large volume containers include three-liter containers, five-liter containers, and ten-liter containers.

The filling system 1 forms four filling positions 3.1-3.4. During filling, each filling position 3.1-3.4 has a container 2 standing upright on its base on a container carrier 4 with its container opening facing upwards and its container axis vertically oriented. Each container 2 is also arranged so that a seal 5.1, best seen in FIG. 2, seals it against the filling head 5.

Figure 2:
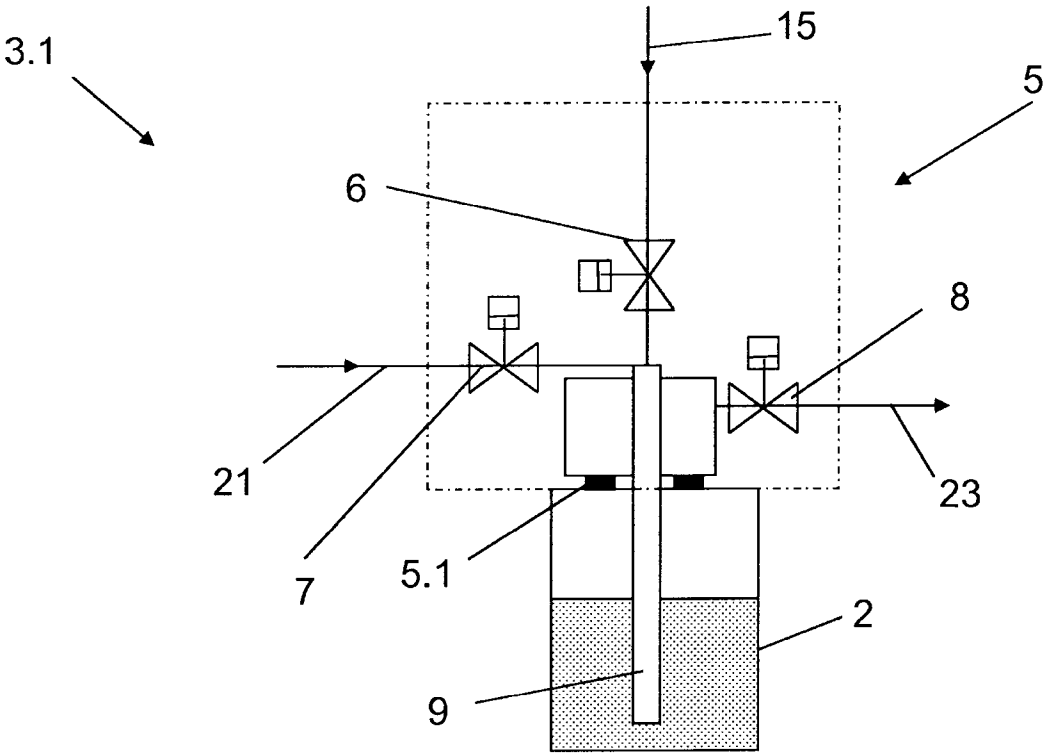
FIG. 2 shows a filling position of the filling system from FIG. 1, together with a container arranged in the sealed position at a filling head or filling element thereof.

Referring to FIG. 2, each filling head 5 has a liquid valve 6, a tension-gas valve 7 that opens on an outlet side, a return-gas valve 8, and a filling pipe 9.

The liquid valve 6 transitions between an open state and a closed state. In the open state, filling-material flows into the container 2. In the closed state, the liquid valve 6 interrupts inflow of filling-material into the container 2.

During filling, the filling pipe 9 extends deep into the container's interior. It is through this filling pipe 9 that filling-material flows during container filling. An upper end of the filling pipe 9 connects to a liquid channel formed in the filling-material head 5 in which the liquid valve 6 is arranged.

The return-gas valve 8 has an inlet that connects to a head space that forms in the container's interior as it fills and an outlet that connects to a return gas pipe 23.

A pump 10 conducts filling-material to the filling heads located at the filling positions 3.1-3.4. The pump's delivery capacity and output pressure can be regulated or controlled, preferably continuously rather than in discrete steps. In some embodiments, the pump 10 has a drive motor whose speed and/or torque can be regulated or controlled by a frequency converter.

On its inlet side, the pump 10 connects to a filling-material tank that provides filling-material. On its outlet side, the pump 10 connects to a product line 11. The product line 11 continues to a first branching-structure 12. At the first branching-structure 12, the product line 11 divides into a pair of first branches 13. Each of the first branches 13 continues to a second branching-structure 14. At the second branching-structure 14, each of the first branches 13 then divides into a pair of second branches 15. Each of the resulting second branches 15, of which there are now four, proceeds to a filling head 5 and to a liquid valve 6 located therein.

In the course of the multiple branching, there is a corresponding stepped reduction of the effective cross-sections of the first branches 13 in relation to the product line 11 and of the second branches 15 in relation to the first branches 13. This corresponding stepped reduction is selected so that, when the liquid valves 6 open in the filling phase, the volume rate of flow of filling-material in all the second branches 15, as well as through all the filling-material heads 5, is the same or very close to the same.

One way to achieve the stepped effective flow cross-section of the first and second branches 13, 15 is to use pipelines having diameters that have been selected to achieve desired inner cross-sections. Another method, which enables the use of any size pipe, is to provide a choke as needed to choke the flow of filling-material.

Producing the stepping of the effective cross-section of the first and second branches 13, 15 with corresponding stepping of the inner cross-sections of the pipes forming these branches results in a static pressure inside these pipes. This static pressure leads to almost identical flow and pressure conditions prevailing at all the filling heads 5 and at their filling-material outlet openings or mouths.

Figure 4:
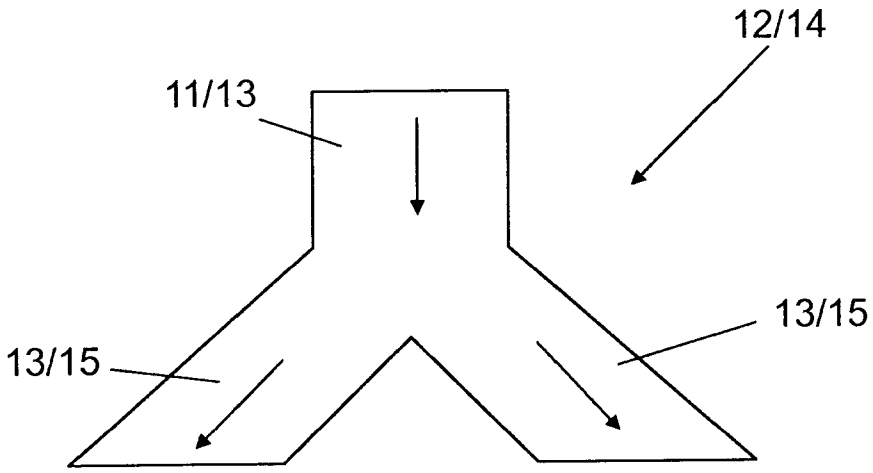
FIG. 4 shows a branching structure used in the system of FIG. 1.

The first and second branching-structures 12, 14 are similar enough so that the reference numerals for both are shown in FIG. 4. Each branching structure 12, 14 is preferably a Y-shaped branch.

A pressure sensor 16 in the product line 11 downstream of the pump 10 constantly monitors the pressure of the filling-material inside the product line 11 and sends a sensor signal indicative of this pressure to a control computer 17.

Based at least in part on this sensor signal, the control computer 17 operates the pump 10 in a way that results in a constant or essentially constant filling-material pressure in the product line 11 at the outlet of the pump 10. This filling-material pressure is, as much as possible, independent of fluctuations in the filling-material volume flow during the filling of the containers 2.

The combination of the pump 10 and the pressure sensor 16 ensures proper delivery of filling-material even without a filling-material tank, and in particular, even without a filling-material tank in which the filling-material is provided at a level above the filling heads 5.

Figure 3:
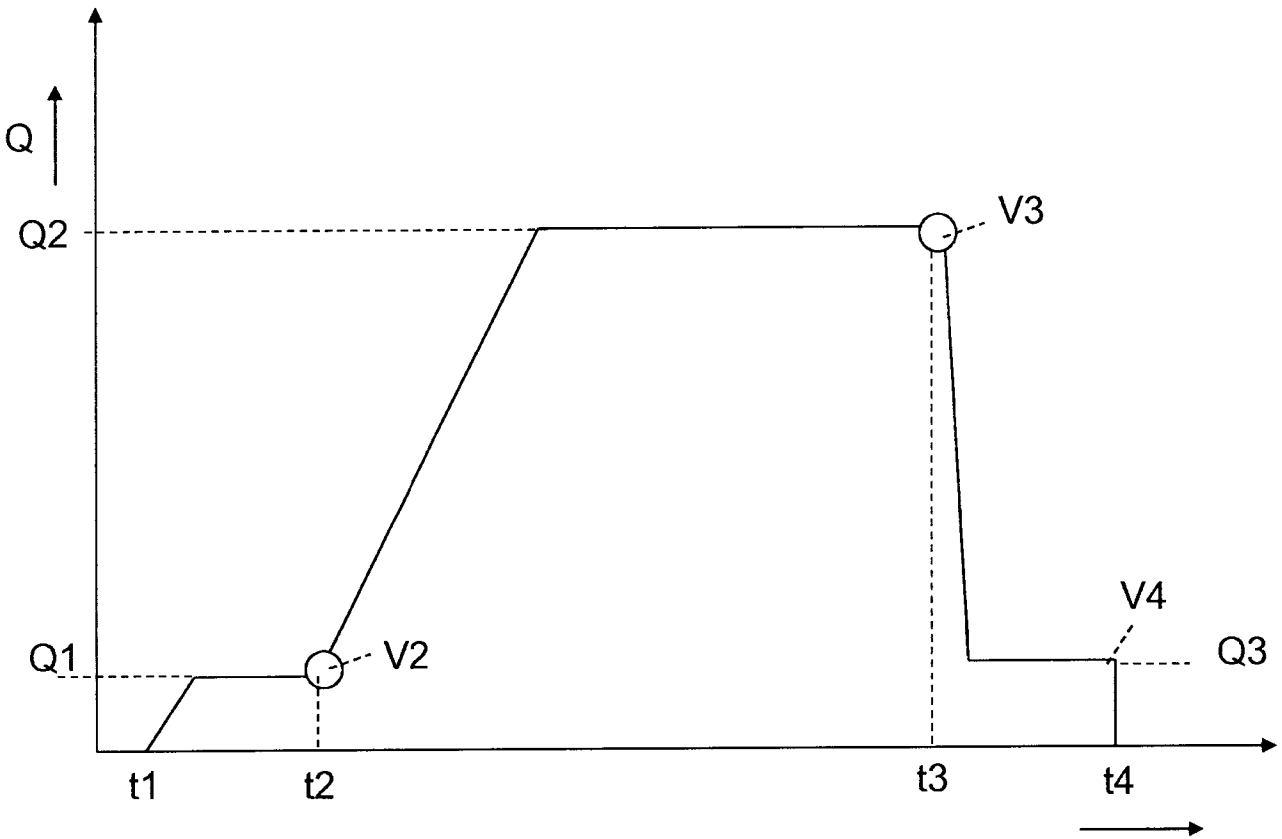
FIG. 3 shows a filling curve to be followed during the filling of the containers at the filling position of FIG. 2.

A volumetric flow-rate controller 18 upstream of the first branching structure 12 controls total filling-material volume flow during the filling phase. In particular, the flow-rate controller 18 controls filling-material flow in accordance with a program stored in a memory of the control computer 17. Such a program is specific to a filling-material and/or to a container. An example of such a program is a target filling-curve that shows flow-rate as a function of time, as shown in FIG. 3.

In some embodiments, the flow-rate controller 18 is a pneumatically actuated. In other embodiments, the flow-rate controller 18 is a DFC controller.

Some embodiments of the flow-rate controller 18 feature a diaphragm that delimits a filling-material channel or thruway located therein. Subjecting the diaphragm to pneumatic control pressure changes an opening cross-section that is available for the filling-material to flow through. This provides a way to control flow of the filling-material as a function of this control pressure.

The control computer 17 controls the flow-rate controller 18 via an I/P converter 19 that converts the electrical control signal from the control computer 17 into the control pressure that ultimately actuates the rate controller 18. Thus, throughout this description, when the flow-rate controller 18 is said to perform an act, it is understood that it does so as a result of control exerted by the control computer 17.

Each second branch 15 has an independent flow meter 20 that delivers an electrical measurement signal indicative of filling-material volume flow through that second branch 15. In some embodiments, the flow meter 20 is a magnetic-inductive flow meter. The measurement signals from the flow meter 20 are likewise sent to the control computer 17 for the control and correction of the filling process in the manner described in greater detail hereinafter.

As shown in FIG. 1, the tension-gas valves 7 of all the filling heads 5 connect on their respective inlet sides to a common tension gas line 21. A tension gas maintained at a tension gas pressure fills the tension gas line 21. Examples of a tension gas include an inert gas, $CO_2$ gas, nitrogen, or sterile air. A tension-gas arrangement 22 connected to a source of tension gas controls the tension gas pressure.

The filling heads 5 can also be subjected to a flushing gas in the manner described above. In this situation, a distinction exists between the flushing gas and the tension gas, as well as between the flushing-gas pressure and the tension-gas pressure.

Each return-gas valve 8 has an outlet that connects to a common return-gas line 23. A pressure sensor 24 on the return-gas line 23 constantly measures the return gas pressure in the return-gas line 23 and provides an output signal indicative of that pressure to the control computer 17.

A return-gas controller 25 lies downstream of the pressure sensor 24 along the return-gas line 23. In some embodiments, the return-gas controller 25 is a pneumatic controller that is actuated by a pneumatic control pressure that is controlled by the control computer 17 as a function of the measurement signals from the pressure sensor 24. An I/P converter 26 converts the pressure measurement into a signal suitable for delivery to the control computer 17. The control computer 17 actuates the return-gas controller 25 in an effort to maintain a constant return gas pressure in the return-gas line 23 is constant.

After passing the return-gas controller 25, the return gas is conducted to a sink, not shown, for the collection of return gas, and specifically via an opened first valve 31 to a gas or vapor separator 28. In some embodiments, the separator 28 is a cyclonic separator. A discharge line 29 conducts away any liquid constituents separated out of the return gas.

For CIP cleaning and/or disinfection of those portions of the filling system 1 that conduct the filling-material and the return gas, the pump 10 pumps a CIP medium through the product lines 11, the first branches 13, the second branches 15, and ultimately to the filling heads 5. The CIP medium returns via the return-gas line 23 to a tank or collection system via a second valve 27.

The first valve 31 also connects an outlet side of the return-gas controller 25 to the gas separator 28. A third valve 30 bypasses the return-gas controller 25 and connects the return-gas line 23 directly to the outlet side of the return-gas controller 25. During CIP cleaning and/or disinfection, the second and third valves 27, 30 open and the first valve 31 closes.

With the containers 2 sealed against their respective filling heads 5, the filling process begins with a pre-tensioning phase. During the pre-tensioning phase, the liquid valves 6 and the return-gas valves 8 all close. Then the tension gas valves 27 open, thus exposing the container interiors to tension gas under pressure. The tension gas enters the containers via the filling pipe 9.

In some practices, a flushing phase precedes the pre-tensioning phase. To execute the flushing phase, the liquid valve 6 closes, the tension-gas valves 7 open, and the return-gas valves 8 open. As a result, the tension gas enters the container's interior via the filling pipe 9, thus forcing air from the container's interior to exit via the return-gas valves 8 and the return-gas line 23.

After pre-tensioning, pressure filling takes place. To carry out pressure filling, the tension-gas valves 7 close, the return-gas valves 8 open, and the liquid valves 6 open. The filling phase ends with closing the liquid valve 6 when the flow meter 20 determines that an appropriate amount of filling-material has entered the container 2.

During the filling, incoming filling-material forces the inert gas out of the container's interior through the return-gas line 23. With the help of the pressure sensor 24, the return-gas controller 25 keeps the return gas pressure constant in the return-gas line 23. This maintains the same conditions for all containers during the pressure filling, including, in particular, conditions within the containers' interiors.

At the end of the filling phase, a pressure-relief valve or pressure-relief line relieves pressure within the containers 2.

During the filling phase, the flow-rate controller 18 causes the flow-rate to follow a target filling-curve FK stored in the memory of the control computer 17. The target filling-curve FK defines a time varying flow-rate specific to the product and/or container.

FIG. 3 shows an example of a target filling-curve FK. The target filling-curve FK shows filling-material flow-rate Q as a function of time at the outlet of the flow-rate controller 18. Ideally, the flow-rate into each container 2 matches that specified in the target filling-curve FK.

As shown in FIG. 3, the liquid valve 6 and return-gas valve 8 open at a first transition time t1. This starts an initial-filling interval. During this initial-filling interval, the flow-rate Q rises until it reaches a first constant flow-rate Q1.

By a second transition time t2, the container has ideally been partially filled with a first volume V2. At this point, the flow-rate controller 18 ends the initial-filling interval and begins a quick-filling interval. In response, the flow-rate Q rises until it reaches a second constant flow-rate Q2. The flow-rate remains constant until a third transition time t3, when the flow-rate controller ends the quick-filling interval. By this time, the container 2 is ideally filled with a second volume V4.

Following the end of the quick filling interval, at the third transition time t3, the flow-rate controller 18 begins an end-filling interval. To do so, the flow-rate controller 18 reduces the flow-rate until it falls to a third constant flow-rate Q3. In the illustrated embodiment, the third constant flow-rate Q3 is only slightly above or below the first constant flow-rate Q1.

The flow-rate remains at the third constant flow-rate Q3 until the flow-rate controller 18 stops all flow. This occurs at a fourth transition time t4. By this time, each container 2 has been filled with the second volume V4 of filling-material.

In a typical embodiment, for a five-liter container, the first constant flow-rate Q1 is on the order of 0.2 liters per second. As a result, 0.15-0.5 liters of filling-material will have entered the container at the end of the initial-filling interval. The second constant flow-rate Q2 is typically on the order of 1.2 liters per second. By the end of the quick-filling interval, some 4.5-4.75 liters of filling-material will have entered each container.

In practice it is not possible to maintain a perfectly constant filling-material volume flow to the filling-material heads 5. Rather, it is necessary that each flow meter 20 measure the actual filling curve at its filling head 5 during the filling phase. This measured filling curve is then compared with the target filling-curve FK stored in the control computer 17. Based on the comparison, the flow controller 18 takes corrective action. This corrective action takes place at the second and third transition times t2, t3.

During each phase of the filling process, the containers will not fill at the same rate. Inevitably, there will be one container that is slowest to fill and another container that is quickest to fill. For convenience of exposition, the former shall be called the "last container" and the latter shall be called the "first container."

To carry out corrective control, the control computer 17 delays the end of the initial-filling interval at the second transition time t2 until the filling-material volume in the last container has reached the first volume V2. The control computer 17 also delays the end of the quick-filling interval at the third transition time t3 until the volume in the last container reaches the second volume V4.

The corrective action takes place at the end of the quick-filling interval such that when the second volume V4 has been conducted to the first container 2 the flow-rate controller 18 starts the end-filling interval for all the containers 2. In the end-filling interval, the liquid valve 6 of each filling head 5 closes independently of all other liquid valves and does so when the required second volume V4 has in fact been introduced into the container 2 concerned.

The corrective action further takes place in such a way that, at the second transition time t2, the controller 18 briefly closes the liquid valves of those filling heads 5 that lead to containers 2 that have already reached the desired first volume V2. This allows the level in the last container 2 to catch up with the others. The liquid valves are then reopened once the required first volume V2 has been introduced into the last container. As a result, the quick-filling interval begins simultaneously for all the containers.

By analogy a similar corrective procedure takes place at the third transition time t3.

In some practices of the filling method, the liquid valves 6 of all the filling heads 5 remain open at the second transition time t2. In that case, flow at the first constant flow-rate Q1 continues into containers other than the last container. Only when the first volume V2 has been introduced into the last container does a switchover to the quick-filling interval take place. At the end of the quick-filling interval, the control computer 17 prematurely closes the liquid valves 6 as needed to take into account an increased filling-material volume at the initiation of the quick-filling interval.

Figure 5:
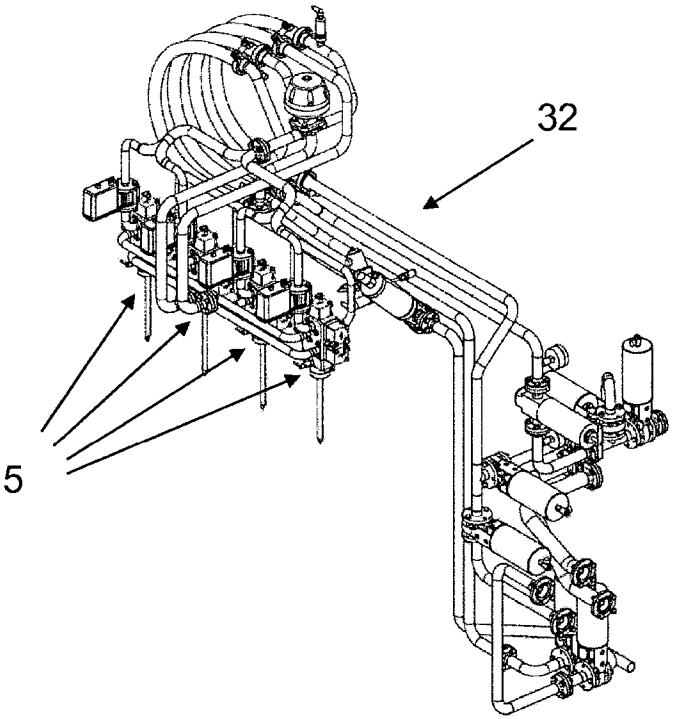
FIG. 5 is a perspective view of a portion of the system shown in FIG. 1.

The filling system 1 as described forms a complete component unit 32, as shown in FIG. 5. The complete component unit 32 is prefabricated and mounted on the machine frame of a filling machine.

The invention has been described heretofore on the basis of an exemplary embodiment. It is understood that numerous modifications and derivations are possible, without thereby leaving the inventive concept on which the invention is based.

The invention claimed is:

1. A method for filling containers with liquid filling-material, said method comprising filling containers simultaneously with said filling-material, wherein filling containers simultaneously comprises placing said containers at corresponding filling positions, sealing said containers against filling heads at said filling positions, and, using a filling-material volumetric-flow-rate controller that is common to all of said filling positions, controlling flow of filling-material as a function of a target filling-curve, wherein controlling flow using said filling-material volumetric flow-rate controller comprises at a first transition time, beginning a filling phase by causing filling-material to flow at a first flow-rate, thereby beginning a first interval of said filling phase, at a second transition time, increasing said first flow-rate to a second flow-rate, thereby ending said first interval and beginning a second interval of said filling phase, at a third transition time, reducing said second flow-rate to a third flow-rate, thereby ending said second interval and beginning a third and final interval of said filling phase, and at a fourth transition time, ending said filling phase, said method further comprising, during said filling phase, measuring actual filling-curves associated with each of said containers, and, based at least in part on said measured actual filling-curves, causing a control computer to implement a correction to cause equal volumes of filling-material to be in each container upon completion of said filling phase, wherein, as a result of an inability to maintain a perfectly constant filling-material volume flow for each container, said containers do not fill at the same rate, wherein, as a result, among said containers, there exists a last container that fills at a rate that is less than the rate at which all others of said containers fill, wherein said method further comprises causing a transition between said first interval and said second interval only when a minimum filling quantity required at the beginning of said second interval has been introduced into said last container.

2. The method of claim 1, wherein causing a control computer to implement a correction comprises causing a temporal displacement of at least one of said second transition time and said third transition time.

3. The method of claim 1, wherein causing a control computer to implement a correction comprises causing a temporal displacement of said fourth transition time.

4. The method of claim 1, further comprising causing said control computer to measure said actual filling-curves in parallel.

5. The method of claim 4, further comprising comparing said actual filling-curves with said target filling-curve, detecting a deviation between at least one actual filling-curve and said target filling-curve, and, in response, causing a change in at least one of said transition times.

6. The method of claim 1, wherein, during said second interval, there exists a first container that fills at a rate that is faster than that at which all other containers fill, wherein said method further comprises switching from said second interval to said third interval only when a filling-material quantity required at the end of said second interval has been filled into said first container.

7. The method of claim 1, further comprising pre-tensioning said containers with tensioning gas, conducting away return gas via a return gas line common to all of said filling positions, and maintaining a constant return gas pressure using a return gas regulator.

8. The method of claim 1, further comprising selecting said filling-material to be a carbonated filling-material, and maintaining a pressure to be above a CO2 balance pressure of said filling-material, wherein said pressure is a return gas pressure.

9. The method of claim 1, further comprising selecting said filling-material to be a carbonated filling-material having a CO2 balance pressure, and maintaining a first pressure to be 1.5 bar above said CO2 balance pressure, wherein said first pressure is a tension gas pressure.

10. The method of claim 1, further comprising selecting said target filling-curve to be specific to said container.

11. The method of claim 1, further comprising selecting said target filling-curve to be specific to said filling-material.

12. An apparatus for simultaneously filling containers with liquid filling-material, said apparatus comprising a control computer, a controller, branched product lines, and filling positions, wherein each filling position comprises a filling head, a tension valve, a liquid valve, a return-gas valve, and an independent magnetic-induction flow meter in a product line leading to said filling head, wherein said controller comprises a filling-material volumetric flow-rate controller, wherein said controller controls filling-material volume flow to said filling positions as a function of a target filling-curve that is stored on said control computer, wherein said control computer actuates said controller according to said target filling-curve, wherein said target filling-curve defines a filling phase that consists of a first interval with a first flow-rate, a second interval following said first interval, said second interval having a second flow-rate, and a third interval having a third flow-rate, said third interval following said second interval, wherein said second flow-rate is greater than either said first or third flow-rate, and wherein said branched product lines connect said filling heads to said controller.

13. The apparatus of claim 12, wherein each filling head further comprises a filling pipe configured to be extended into a container to be filled, said filling pipe being configured to switch between being connected to a source of tension gas and being connected to a source of said filling material.

14. The apparatus of claim 12, further comprising a common tension gas line, a common return gas line, a return gas regulator, and a pressure sensor, wherein said tension valves of said filling heads all connect to said common tension gas line, wherein said return gas valves of said filling heads all connect to said common return gas line, wherein said return gas regulator and said pressure sensor are provided in said common return gas line, and wherein said return gas regulator is configured to maintain constant return gas pressure in said return gas line based at least in part on a pressure signal provided by said pressure sensor.

15. The apparatus of claim 12, wherein said controller, said branched product lines, and said filling positions define a preassembled component unit to be mounted as a unit on a machine frame of a filling machine.

16. The apparatus of claim 12, wherein said branched product lines comprise a first product line and a first branching structure at which said first product line divides into a pair of first branches.

17. The apparatus of claim 16, wherein each of said first branches continues to a second branching-structure, wherein, at each of said second branching-structures, each of said first branches then divides into a pair of second branches.

18. The apparatus of claim 17, wherein each of said second branches proceeds to a corresponding filling head.

19. The method of claim 1, wherein during each phase of the filling process, said containers will not all be filling at the same flow rate.

* * * * *